US008927935B1

(12) United States Patent
Meline

(10) Patent No.: US 8,927,935 B1
(45) Date of Patent: Jan. 6, 2015

(54) ALL ELECTRO OPTICAL BASED METHOD FOR DECONFLICTION OF MULTIPLE, CO-LOCATED DIRECTED ENERGY, HIGH ENERGY LASER PLATFORMS ON MULTIPLE, NEAR SIMULTANEOUS THREAT TARGETS IN THE SAME BATTLE SPACE

(75) Inventor: Michael E. Meline, Albuquerque, NM (US)

(73) Assignee: The Boeing Company, Chicago, IL (US)

( * ) Notice: Subject to any disclaimer, the term of this patent is extended or adjusted under 35 U.S.C. 154(b) by 261 days.

(21) Appl. No.: 13/476,348

(22) Filed: May 21, 2012

(51) Int. Cl.
*F41H 13/00* (2006.01)

(52) U.S. Cl.
CPC ..... *F41H 13/0062* (2013.01)
USPC ..... 250/340

(58) Field of Classification Search
CPC .... F41H 7/005; F41H 13/005; F41H 13/0062
USPC ..... 250/340
See application file for complete search history.

(56) References Cited

U.S. PATENT DOCUMENTS

| | | | | |
|---|---|---|---|---|
| 5,198,607 | A * | 3/1993 | Livingston et al. | 89/1.11 |
| 7,912,631 | B2 * | 3/2011 | Howard et al. | 701/519 |
| 2010/0282942 | A1 * | 11/2010 | Mosier et al. | 250/203.2 |

* cited by examiner

*Primary Examiner* — Constantine Hannaher
(74) *Attorney, Agent, or Firm* — Vista IP Law Group LLP; Cynthia A. Dixon

(57) ABSTRACT

A general problem occurs when there are multiple High Energy Laser (HEL) systems designed to shoot down threat targets (e.g., rockets, artillery, and mortar (RAM), and unmanned aerial systems (UASs) and vehicles (UAVs)) in scenarios where there are multiple, simultaneous, impending threat targets. To achieve the highest target kill ratio or highest protection force efficiency, the HEL systems need to be independently allocated to unique threat targets at each specific time, such that the case where two or more HEL systems are shooting at the same target is avoided (referred to as "target deconfliction"). The present disclosure teaches an all electro optical (EO) solution that exploits the use and affects of the HELs focused on targets and, thus, eliminates the need for any battle management (BM) and command and control (C2) systems that are currently conventionally used for target deconfliction.

18 Claims, 3 Drawing Sheets

ALL ELECTRO OPTICAL BASED METHOD FOR DECONFLICTION OF MULTIPLE, CO-LOCATED DIRECTED ENERGY, HIGH ENERGY LASER PLATFORMS ON MULTIPLE, NEAR SIMULTANEOUS THREAT TARGETS IN THE SAME BATTLE SPACE

BACKGROUND

The present disclosure relates to high energy laser (HEL) platforms. In particular, it relates to an all electro optical (EO) based method for deconfliction of multiple, co-located directed energy (DE), high energy laser (HEL) platforms (and/or Kinetic Energy (KE) platforms) on multiple, near simultaneous threat targets in the same battle space. The disclosed method and system are used to prevent more than one HEL platform from shooting at the same threat target that is already being lased.

SUMMARY

The present disclosure relates to a method, system, and apparatus for an all electro optical (EO) based method for deconfliction of multiple, co-located directed energy (DE), high energy laser (HEL) platforms (and/or Kinetic Energy (KE) interceptor platforms) on multiple, near simultaneous threat targets in the same battle space. In one or more of the embodiments a disclosed method for deconfliction of two or more HEL platforms (and/or KE platforms), in the same battle space, from shooting the same target involves sensing and discriminating the characteristic heat (or infrared (IR) signature) that is created when one or more of the HEL platforms is illuminating the threat target with a focused, or nearly focused, HEL beam. The method further involves sensing, with two or more IR sensors, at least one onboard each HEL platform, an IR signature for each of the threat targets. Also, the method involves distinguishing, with at least one processor per IR sensor, the illuminated threat target(s) from the other threat targets that are not illuminated by analyzing the IR signature of each of the threat targets. In addition, the method involves determining, with at least one processor per sensor, whether the IR signature of any of the threat targets exceeds a defined HEL-on-target IR signature threshold. Additionally, the method involves logically commanding the HEL platforms (and/or KE missile or projectile interceptor platforms) to not engage and/or attempt to shoot any of the threat targets that have an IR signature that exceeds the HEL-on-target IR signature threshold (which is an IR signature that is consistent with a threat target being lased by a HEL beam at or near focus), and to moving to a threat target(s) that has an IR signature that does not exceed the HEL-on-target IR signature threshold (which is an IR signature that is typical of threat target not being lased or illuminated by an HEL beam).

In one or more embodiments, the disclosed method further involves ordering the threat targets in an engagement queue, one for each HEL platform (or KE platform), where the threat target in the front of the engagement queue is the first to be illuminated. In some embodiments, targets in order of priority in the queue that have an IR signature that exceeds the HEL-on-target IR signature threshold are skipped or removed from the queue to allow the remaining HEL platforms, not lasing the same target, to proceed to the next threat target(s) in the engagement queue that has an IR signature that does not exceed the HEL-on-target IR signature threshold.

In at least one embodiment, at least two focused, or nearly focused, laser beams are high energy lasers (HEL), or one focused, or nearly focused, HEL system with at least one KE missile or projectile interceptor system. In one or more embodiments, the source for at least two focused laser beams is mobile and/or stationary. In some embodiments, the source for at least two focused, or nearly focused, laser beams is terrestrial, airborne, marine, and/or space based.

In one or more embodiments, at least one of the threat targets is mobile and/or stationary. In at least one embodiment, at least one of the threat targets is terrestrial, airborne, marine, and/or space based. In some embodiments, at least two IR sensors are mobile and/or stationary. In one or more embodiments, at least two IR sensors are terrestrial, airborne, marine, and/or space based.

In at least one embodiment, a system for deconfliction of multiple, near simultaneous, threat targets in a same battle space involves at least two focused, or nearly focused, laser beams to illuminate at least one of the threat targets. The system further involves at least two infrared (IR) sensors to sense an IR signature for each of the threat targets. Also, the system involves at least one processor per sensor to distinguish the illuminated threat target(s) from the other threat targets that are not illuminated by analyzing the IR signature of each of the threat targets; to determine whether the IR signature of any of the threat targets exceeds a defined HEL-on-target IR signature threshold; and to effect the HEL (and/or KE) platforms to not engage and/or attempt to shoot any of the threat targets that have an IR signature that exceeds the HEL-on-target IR signature threshold, and to engage the threat target(s) that has an IR signature that does not exceed the HEL-on-target IR signature threshold.

In one or more embodiments, the disclosed system further involves an engagement queue for each HEL platform, for the threat targets, where the threat target in the front of the engagement queue is first to be illuminated. In at least one embodiment, at least one processor per IR sensor distinguishes targets that have IR signatures that exceed the HEL-on-target IR signature threshold (which is an IR signature that is consistent with targets that are illuminated with a HEL beam focused, or nearly focused, on the target) to allow HEL platforms to be logically commanded to engage the next highest priority threat target(s) in the engagement queue that has an IR signature that does not exceed the HEL-on-target IR signature threshold.

The features, functions, and advantages can be achieved independently in various embodiments of the present inventions or may be combined in yet other embodiments.

DRAWINGS

These and other features, aspects, and advantages of the present disclosure will become better understood with regard to the following description, appended claims, and accompanying drawings where:

DESCRIPTION

Figure 1:
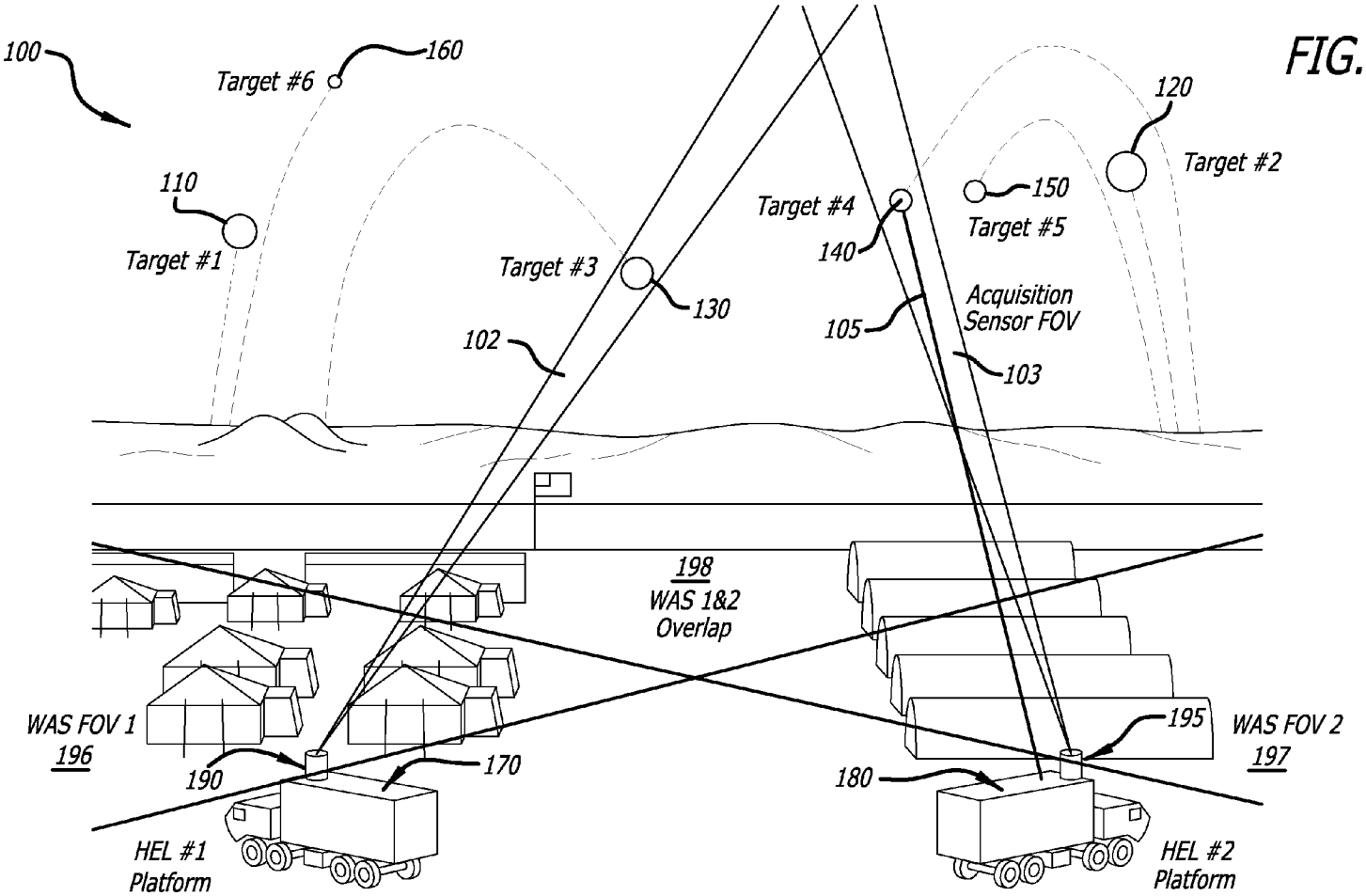
FIG. 1 is a diagram of the disclosed system for deconfliction of multiple, near simultaneous, threat targets in the same terrestrial battle space, in accordance with at least one embodiment of the present disclosure.

The methods and apparatus disclosed herein provide an operative system for an all electro optical (EO) based method for deconfliction of multiple, co-located directed energy (DE), high energy laser (HEL) platforms (and/or one or more Kinetic Energy (KE) interceptor platforms) on multiple, near simultaneous, threat targets in the same battle space. In particular, the system employs infrared (IR) sensors to sense IR signal characteristics (or heat signatures) for each of the threat targets, and utilizes these IR signatures to determine when deconfliction of the HELs is needed.

A general problem occurs when there are multiple High Energy Laser (HEL) systems designed to shoot down threat targets (e.g., rockets, artillery, and mortar (RAM), and unmanned aerial systems (UASs) and vehicles (UAVs)) in scenarios where there are multiple, simultaneous, impending threat targets. To achieve the highest target kill rate per group of HEL platforms or highest force protection efficiency, the HEL systems need to be independently allocated to unique threat targets at each specific time, such that the case where two or more HEL systems shooting at the same threat target at the same time is avoided (this is referred to as "target deconfliction").

Currently, this problem is addressed by utilizing real-time communication, coordination, and processing of radar, and electro optical (EO) cameras and trackers across high speed communication networks as part of battle management (BM) and command and control (C2) systems. It should be noted that for rocket, artillery mortar (RAM) threat targets, the threat target deconfliction problem must be solved in a matter of a few seconds, which further drives the cost and complexity of the BM-C2 systems. Additionally, existing BM-C2 systems may not be capable of supporting such short timelines due to their inherent processing and/or communication latency.

The present disclosure teaches an all electro optical (EO) solution that exploits the use and affects of the HELs focused, or nearly focused, on targets and, thus, eliminates the need for network communication dependent battle management BM-C2 systems that are conventionally used for target deconfliction. The disclosed all EO solution significantly reduces the deployment cost to the military and the cost to each HEL system to resolve the target deconfliction problem by using existing on-board EO passive or active cameras and trackers (or added passive or active cameras and trackers).

As previously mentioned above, the disclosed system utilizes IR signatures of the threat targets to determine when deconfliction needs to be executed. When threat targets are lazed with HELs (i.e. lasers powers of 50 watts or more depending on the range between the HEL platform and the target), their temperature will rise over time in a localized spot or pattern on the threat target (in an area on the threat target where the HEL beam is hitting), thereby creating a distinguishable IR signature relative to the non-lased threat target case. Typically, non-lased threat targets are just a few degrees in temperature over ambient temperature, and if lased with a HEL focused beam, the temperature of the material of the threat target will increase in the area where the HEL beam is hitting the threat target, or on a significant portion of the whole threat target, such that its IR signature would be distinguishable from non-lased threat target IR signatures by the use of passive IR cameras or sensors viewing these same threat targets. The disclosed system utilizes a passive camera HEL on target detection algorithm (PCHOTDA) in order to distinguish between threat targets that are being lased and non-lased threat targets. By implementing the PCHOTDA in the tracker video processing section of the camera or sensor, a timely determination of a threat target being lased can be used to deconflict HEL units from shooting at the same threat target at the same time.

Battle field enemy fires and threats (e.g., Rockets, Arillery, Mortar, (RAM), Unmanned Aerial Systems (UAS)s, and/or Unmanned Aerial Vehicles (UAV)s) typically have a predictably low electro optical (EO) signal to noise (SNR) as seen by passive sensors or cameras designed to detect and track these threats. HEL platforms are designed to track these threats down to very low IR signature levels across many of the classical infrared (IR) sensor wave bands, such as, short-wave infrared (SWIR) band, mid-wave IR (MWIR) band, and/or long wave IR (LWIR) band of the electromagnetic (EM) spectrum. When these threat targets are lased with HELs, a distinguishable IR signature is created relative to the IR signature of the non-lased threat target case. Infrared sensors and/or cameras viewing these same threat targets are able to distinguish between threat targets being lased with HEL beams and non-lased threat targets by viewing the IR signatures of the threat targets. HEL systems and KE systems are almost always equipped with onboard SWIR, MWIR, and/or LWIR passive acquisition sensors and wide area surveillance sensors (WASS) for the purpose of passive detection and closed loop tracking of threat targets. The radiometric performance of these sensors is well characterized, such that signal levels or SNRs for known threat targets that are not being lased by HELs is predictable in real time. By establishing a lower, non-lased SNR threshold and a hot spot location on the threat target (determined by a priori target or target class knowledge, and engagement geometry), a contrast between the lased and non-lased targets can be determined in real time by tracking processors using the sensed IR signatures of the threat targets.

Furthermore, current technology is capable of providing "two color sensors" in one focal plane that are capable of simultaneous sensing in two different EM wave bands. By having one sensor designed for sensing the HEL wavelength, and the other sensor designed for classical passive tracking as described above, in another IR wave band, a further confirmation of HEL lasing on a threat target being tracked can be achieved with additional redundancy. Once threat targets are determined as being lased by an individual HEL unit or platform, they can be eliminated from the engagement queue for the remaining HEL units (and/or KE units) not already shooting at the same target. The remaining HEL units (and/or KE units) will then move on to the next threat target in its engagement queue, thereby deconflicting the HEL units (and/or KE units) from simultaneously shooting at the same threat target that another HEL unit is already lasing.

It should be noted that the disclosed system may be utilized for deconfliction of various different types of threat targets. The various different types of threat targets include, but are not limited to, air-breathing and airborne threat targets, ballisitic threat targets (e.g., missiles (e.g., short range ballistic missiles (SRBMs), tactile ballistic missiles (TBMs), and intercontinental ballistic missiles (ICBMs)), rockets, mortars, rocket assisted mortars, artillery, rocket power grenades, man-portable air defense systems (MANPADS), cruise missiles, surface to air missiles, air to air missiles, air to ground missiles, reentry vehicles (RVs), warhead transport buses, decoys, space debris, unmanned aerial systems (UASs), unmanned aerial vehicles (UAVs), rotocraft, fixed wing aircraft, and high altitude balloon platforms).

In the following description, numerous details are set forth in order to provide a more thorough description of the system. It will be apparent, however, to one skilled in the art, that the disclosed system may be practiced without these specific details. In the other instances, well known features have not been described in detail so as not to unnecessarily obscure the system.

FIG. 1 is a diagram of the disclosed system 100 for deconfliction of multiple, near simultaneous threat targets 110, 120, 130, 140, 150, 160 in the same battle space, in accordance with at least one embodiment of the present disclosure. In this figure, the targets are numbered (i.e. target 1 110, target 2 120, target 3 130, target 4 140, target 5 150, and target 6 160) in ascending order from the first to be launched to the last to be launched over time (i.e. target 1 110 is first to be launched, and target 6 160 is last to be launched). HEL unit 1 170 and HEL unit 2 180 each have wide angle sensors (WAS) 190, 195 (e.g., infrared sensors) that each have a field of view (FOV) 196, 197 of approximately 180 degrees in azimuth and 90 degrees in elevation. HEL unit 1 170 and HEL unit 2 180 are oriented such that their respective WAS 190, 195 FOVs 196, 197 overlap 198 with each other in order to detect and engage threat targets 110, 120, 130, 140, 150, 160 within the same battle space, while providing defensive coverage to more than a single WAS 190, 195 FOV 196, 197. The acquisition sensor FOVs 102, 103 as well as a laser beam 105 being radiated from HEL unit 2 180 are also shown in this figure.

The tracking processors (not shown) on the WAS 190, 195 cameras for HEL unit 1 170 and HEL unit 2 180 each trigger a passive camera HEL laser on target detection algorithm (PCHOTDA) (i.e. PCHOTDA detects a target being lased). The PCHOTDA is used to determine whether a threat target is currently being lased by one or more HELs. For example, with regard to threat target 4 140, WAS 190 senses the IR signature of threat target 4 140. The tracking processor on the WAS 190 camera uses the PCHOTDA to determine whether the sensed IR signature for threat target 4 140 exceeds a defined HEL-on-target IR signature threshold. If the PCHOTDA determines that the sensed IR signature exceeds the defined HEL-on-target IR signature threshold, the tracking processor will determine that threat target 4 140 is already being lased by another HEL platform and skip this target and select the next highest priority non-lased target. However, if the PCHOTDA determines that the sensed IR signature does not exceed the defined HEL-on-target IR signature threshold, the tracking processor will determine that the threat target 4 140 is not being lased by any HEL platform and proceed with the engagement of the HEL lasing this target.

In this example, since threat target 4 140 is being lased by a laser beam 105 being radiated from HEL unit 2 180, the tracking processor on the WAS 190 camera running the PCHOTDA algorithm determines that the IR signature of threat target 4 140 exceeds the HEL-on-target IR signature threshold. Without deconfliction, HEL unit 1 170 would engage target 4 140 next as it has just finished engaging and killing target 3 130 because target 4 140 is closest in time and space to the direction where HEL unit 1 170 is already pointing, and because target 4 140 is the current most immediate threat to the defended area as it has not been killed yet. However, since the PCHOTDA running on the tracking processor on the WAS 190 camera for HEL unit 1 170 determines that threat target 4 140 is already being lased by another HEL, HEL unit 1 170 removes target 4 140 from its engagement queue. HEL unit 1 170 then proceeds to the next target in its queue, which in this example, is target 5 105, as it is the next most immediate threat. With HEL unit 1 170 avoiding the time (i.e. primarily the slew and lasing time) of engaging target 4 104, the effective target kill rate (i.e. number of targets killed per time) for HEL unit 1 170 and HEL unit 2 180 is increased significantly, closer to the physical limit, with no additional intra HEL Unit network message traffic, and with low processing burden and latency.

Other HEL unit to target deconfliction algorithms based on intra HEL unit (or KE unit) message communication, target priority, and allocation algorithms are understood to be much more computationally intensive and are more likely to impact the engagement timeline. This logic can be generalized to many, or "M," HEL units (and/or KE units) that have passive sensors with overlapping sensor FOVs, turret Field of Regards (FOR), and/or acquisition sensors with many, or "N," simultaneous threat targets in the same battle space. If WAS sensors are not part of each HEL unit (or KE unit) configuration, the PCHOTDA can be applied to the passive acquisition sensor for each HEL unit (or KE unit). Acquisition sensor fields of view typically have much more narrow fields of view than wide angle sensors. The net result of applying the PCHOTDA to just the acquisition sensor is that the HEL Units may still slew their turrets or gimbal to the same target, but will not lase (or shoot at) the same target simultaneously with different HELs. In this case, the additional lase time for the HEL or the flyout time of the interceptor missible is avoided, but not the additional time to slew to the same target.

Figure 2:
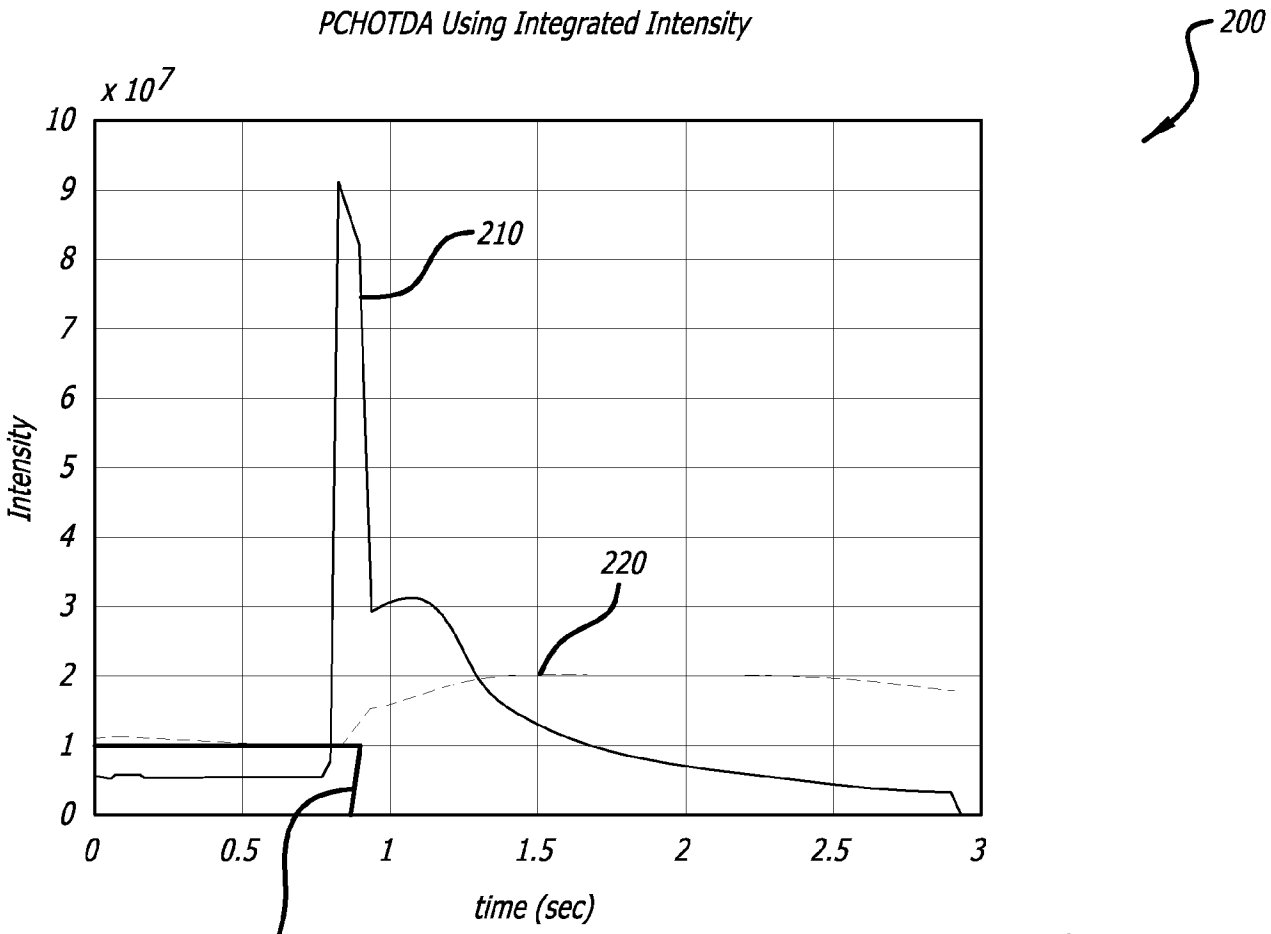
FIG. 2 is a graph depicting the signal level logic of the Passive Camera HEL On Target Detection Algorithm (PCHOTDA), which is employed by the HEL platforms of FIG. 1, in accordance with at least one embodiment of the present disclosure.

FIG. 2 is a graph 200 depicting the signal level logic of the passive camera HEL on target detection algorithm (PCHOTDA), which is employed by the passive cameras (in the WASs and Acquisition sensors) in both HEL platforms of FIG. 1, in accordance with at least one embodiment of the present disclosure. The PCHOTDA is implemented in the video processing stage for each tracking processor associated with each passive camera. The PCHOTDA is applied by creating a signal 210 that comprises the integrated intensity (i.e. sum of pixels above a threshold in the IR tracking camera sensor) in each of the camera's field of view (FOV) per frame. Alternatively, pixels above the track detection threshold, that are only inside the track gate per frame, may be used in the PCHOTDA for the multi-target tracking case, where more than one target is in the sensor's FOV. Additionally, pixels above threshold in just the track gate could also be used for cases with targets that have existing heat signatures from rocket plumes, for example, where the track gate partitions the already hot part of the target from the location of the HEL contact location on the target. By comparing the instantaneous value of the integrated intensity signal 210 to a Laser On Detection Threshold 220, a Laser On Boolean 230 or true-false signal is created. When the integrated intensity signal 210 crosses the Laser On Detection Threshold 220, the Laser On Boolean 230 becomes true, indicating HEL on the target. The Laser on Boolean 230 is false when it is either below or drops below the Laser On Detection Threshold 220, thereby indicating that the HEL is not lasing the target The Laser On Detection Threshold 220 can be created in a number of ways, and its value may need to be arrived at by field calibration of the sensor in its environment with threat targets or test targets. One proven method is to low pass filter the integrated intensity from the IR sensor viewing the target to create the signal 210 and multiply the filtered value by a factor of two (2) to create the Laser on Detection Threshold 220. When a target is being lased, the integrated intensity 210 will climb to greater than approximately 2 times higher or more than the non-lased condition and will cross the Laser on Detection Threshold 220. The Laser on Detection Threshold 220 will more slowly rise creating hysteresis to prevent chatter or rapid state transitions of the Laser On Boolean signal 230.

The change in amplitude of the integrated intensity signal 210 before and after the target being lased is dependent on several factors, with the dominate ones being the net irradiance from the HEL absorbed by the target, the target's heat emission due to being lazed, and the target's range from the HEL Unit. The Laser On Detection Threshold 220 could be calibrated to be a value such that if a target is being lased, but is not being heated up sufficiently to cause the PCHOTDA algorithm to trigger, then the target being lased should and will be lased by another HEL unit to ensure that it is killed.

Figure 3:
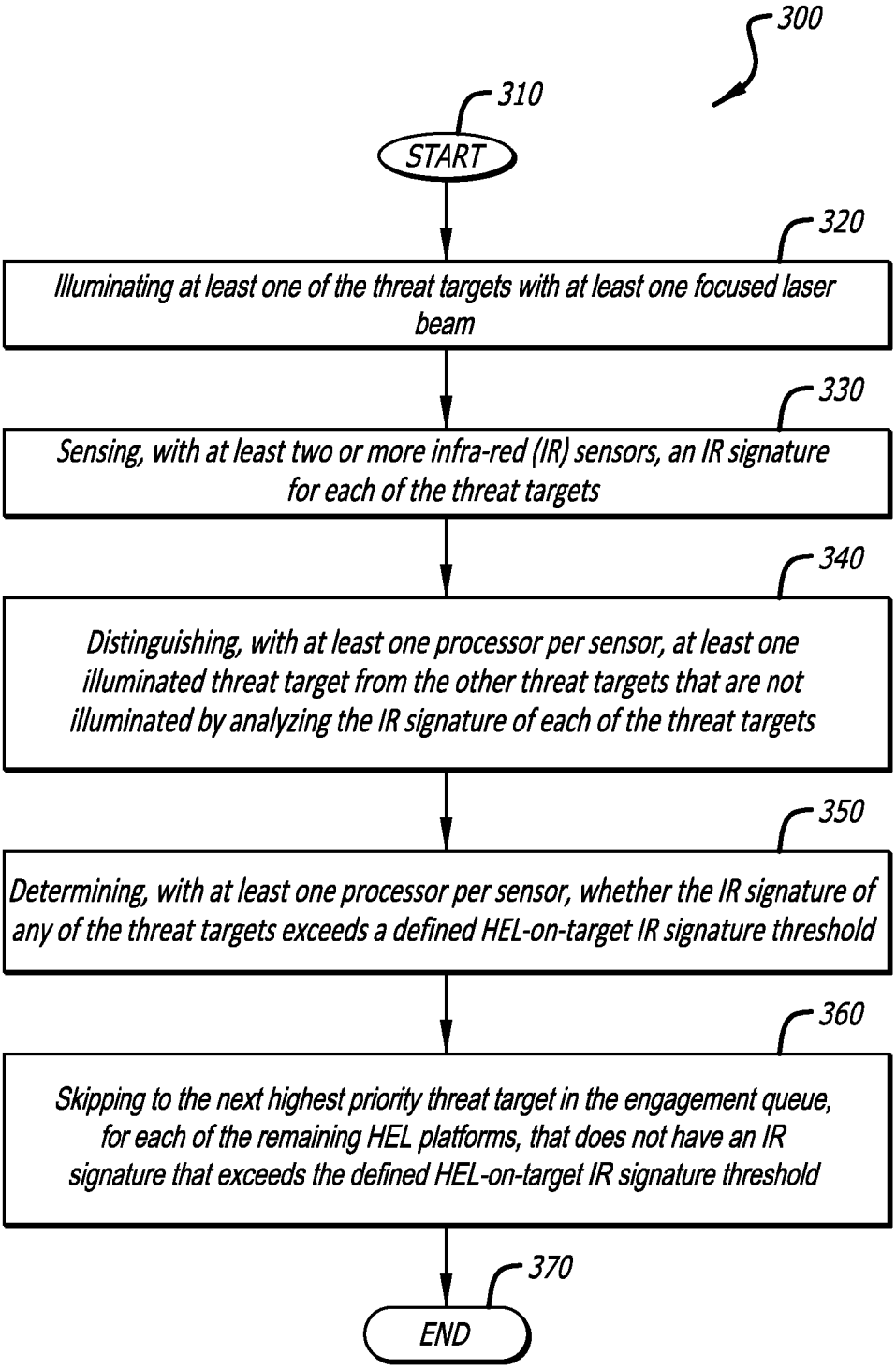
FIG. 3 is a flowchart for the disclosed method for deconfliction of multiple, near simultaneous, threat targets in the same battle space, in accordance with at least one embodiment of the present disclosure.

FIG. 3 is a flowchart 300 for the disclosed method for deconfliction of multiple, near simultaneous threat targets in the same battle space, in accordance with at least one embodiment of the present disclosure. At the start 310 of the method, at least one focused, or nearly focused, laser beam (e.g., a HEL) illuminates at least one of the threat targets 320. Then, two or more infrared sensors sense the IR signature for each of the threat targets 330. At least one processor per IR sensor then distinguishes the illuminated threat target(s) from the other threat targets that are not illuminated by analyzing the IR signature of each of the threat targets 340. Then, for each HEL platform (or KE platform) in the battle space viewing the same threat targets, at least one processor per IR sensor determines whether the IR signature of any of the threat targets exceeds a defined HEL-on-target IR signature threshold 350. At least one processor per IR sensor determines the threat targets that are being lased by the HELs via the PCHOTDA algorithm, and removes those threat targets from the engagement queue or target priority list. The remaining HEL platforms (and/or KE platforms), that are not already lasing or engaging a target, skip over pursuing targets being lased as determined by the PCHOTDA algorithm to pursuing the next highest priority target not being lased also determined by the PCHOTDA algorithm 360. The example scenario ends at this point 370.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

I claim:

1. A method for deconfliction of multiple, near simultaneous, threat targets in a same battle space, the method comprising:

illuminating at least one of the threat targets with at least one at least partially focused laser beam from at least one high energy laser (HEL) platform operating autonomously without battle management network communication;

sensing, with two or more infrared (IR) sensors, an IR signature for each of the threat targets;

distinguishing, with at least one processor associated with one of the IR sensors, at least one illuminated threat target from other threat targets that are not illuminated by analyzing the IR signature of each of the threat targets;

determining, with the at least one processor associated with one of the IR sensors, whether the IR signature of any of the threat targets exceeds a defined IR signature threshold; and moving the at least one laser beam away from any of the threat targets that have an IR signature that exceeds the IR signature threshold to at least one of the threat targets that is a next highest priority threat target in an engagement queue that does not have an IR signature that exceeds the IR signature threshold.

2. The method of claim 1, wherein the method further comprises ordering the threat targets in the engagement queue, wherein the threat target in a front of the engagement queue is first to be illuminated.

3. The method of claim 1, wherein the at least one laser beam is a high energy laser (HEL).

4. The method of claim 1, wherein at least one of the threat targets is at least one of mobile and stationary.

5. The method of claim 1, wherein at least one of the threat targets is at least one of terrestrial, airborne, marine, and in space.

6. The method of claim 1, wherein a source for the at least one laser beam is at least one of mobile and stationary.

7. The method of claim 1, wherein a source for the at least one laser beam is at least one of terrestrial, airborne, marine, and space based.

8. The method of claim 1, wherein at least one of the two or more IR sensors is at least one of mobile and stationary.

9. The method of claim 1, wherein at least one of the two or more IR sensors is at least one of terrestrial, airborne, marine, and space based.

10. A system for deconfliction of multiple, near simultaneous, threat targets in a same battle space, the system comprising:

at least one, at least partially focused, laser beam, from at least one high energy laser (HEL) platform operating autonomously without battle management network communication, to illuminate at least one of the threat targets;

at least two or more infrared (IR) sensors to sense an IR signature for each of the threat targets;

at least one processor associated with one of the IR sensors to distinguish the at least one illuminated threat target from other threat targets that are not illuminated by analyzing the IR signature of each of the threat targets, to determine whether the IR signature of any of the threat targets exceeds a defined IR signature threshold, and to cause the at least one laser beam to be moved away from any of the threat targets that have an IR signature that exceeds the IR signature threshold and moved to at least one of the threat targets that is a next highest priority threat target in an engagement queue that does not have an IR signature that exceeds the IR signature threshold.

11. The system of claim 10, wherein the threat targets are ordered in the engagement queue, and wherein the threat target in a front of the engagement queue is first to be illuminated.

12. The system of claim 10, wherein the at least one laser beam is a high energy laser (HEL).

13. The system of claim 10, wherein at least one of the threat targets is at least one of mobile and stationary.

14. The system of claim 10, wherein at least one of the threat targets is at least one of terrestrial, airborne, marine, and in space.

15. The system of claim 10, wherein a source for the at least one laser beam is at least one of mobile and stationary.

16. The system of claim 10, wherein a source for the at least one laser beam is at least one of terrestrial, airborne, marine, and space based.

17. The system of claim 10, wherein at least one of the two IR sensors is at least one of mobile and stationary.

18. The system of claim 10, wherein at least one of the two IR sensors is at least one of terrestrial, airborne, marine, and space based.

* * * * *